US006761646B1

(12) United States Patent
Yamagishi et al.

(10) Patent No.: US 6,761,646 B1
(45) Date of Patent: Jul. 13, 2004

(54) MULTI-PIECE SOLID GOLF BALL

(75) Inventors: Hisashi Yamagishi, Chichibu (JP); Hiroshi Higuchi, Chichibu (JP); Junji Hayashi, Chichibu (JP); Akira Kawata, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 09/170,216

(22) Filed: Oct. 13, 1998

(30) Foreign Application Priority Data

Oct. 13, 1997 (JP) ..... 9-294866

(51) Int. Cl.[7] ..... A63B 37/06
(52) U.S. Cl. ..... 473/374
(58) Field of Search ..... 473/374, 378, 473/373, 375, 376, 377; 428/375, 376, 377

(56) References Cited

U.S. PATENT DOCUMENTS

| | | | | |
|---|---|---|---|---|
| 4,919,434 A | | 4/1990 | Saito | |
| 5,253,871 A | | 10/1993 | Viollaz | |
| 5,439,227 A | | 8/1995 | Egashira et al. | |
| 5,688,595 A | * | 11/1997 | Yamagishi et al. | 473/378 X |
| 5,830,085 A | * | 11/1998 | Higuchi et al. | 473/378 X |
| 5,876,294 A | * | 3/1999 | Yamagishi et al. | 473/374 |

FOREIGN PATENT DOCUMENTS

| | | |
|---|---|---|
| GB | 2 299 517 A | 10/1996 |
| GB | 2 302 330 A | 1/1997 |
| GB | 2 302 546 A | 1/1997 |
| JP | 4-48473 | 8/1992 |
| JP | 4-244174 | 9/1992 |
| JP | 6-343718 | 12/1994 |
| JP | 7-24084 | 1/1995 |
| JP | 7-24085 | 1/1995 |
| JP | 7-8301 | 2/1995 |
| JP | 9-10357 | 1/1997 |
| JP | 9-10358 | 1/1998 |

* cited by examiner

*Primary Examiner*—Sam Rimell
(74) *Attorney, Agent, or Firm*—Sughrue Mion, PLLC

(57) ABSTRACT

In a multi-piece solid golf ball comprising a solid core, a cover inner layer and a cover outer layer, the solid core undergoes a deflection of 3–7 mm under a load of 100 kg, the cover inner layer has a Shore D hardness of 25–58 and a thickness of 0.5–1.4 mm, the cover outer layer has a Shore D hardness of 30–62 and a thickness of 1.2–2.3 mm, and the ratio of the thickness of the cover outer layer to the thickness of the cover inner layer is from 1.1 to 4.6. The ball is improved in playability, feel and durability.

20 Claims, 1 Drawing Sheet

MULTI-PIECE SOLID GOLF BALL

BACKGROUND OF THE INVENTION

1. Field of the Invention

This invention relates to a multi-piece solid golf ball having improved spin, feel, durability and distance.

2. Prior Art

Solid golf balls having multilayer structure covers are well known in the art as disclosed in JP-B 48473/1992, JP-A 343718/1994, 24084/1995, 24085/1995, and 10357/1997. JP-B 8301/1995 discloses a solid golf ball having a two-layer cover having high flexural rigidity, both the inner and outer layers having high hardnesses. Since the cover outer layer is relatively thin, this golf ball has problems with respect to the cut durability when half topped and the durability against repetitive shots.

JP-A 244174/1992 discloses a golf ball comprising a solid core, an intermediate layer and a cover wherein the intermediate layer is relatively hard and thick while the cover is made soft and thin. When hit, this golf ball receives an increased spin rate and thus travels a skying trajectory, failing to extend distance.

Attempts have also been made to improve the feel and spin controllability of multi-piece solid golf balls. For example, JP-A 24084/1995 discloses a golf ball comprising a cover including a relatively hard, thick outer layer and a relatively thick inner layer. JP-A 10358/1997 discloses a golf ball comprising a cover including a soft inner layer and an outer layer slightly softer than the inner layer.

Despite these prior efforts to improve golf balls, few of the golf balls having a cover consisting of a soft thick inner layer and a relatively thick outer layer slightly softer than the inner layer are satisfactory in feel on all shots ranging from the driver to the putter. Also desired is an improvement in spin control to comply with different clubs.

When a golf ball undergoes a great deformation as on full shots with a driver, the hardnesses of the core and enclosing components have combined effects on the flight distance and feel of the ball. When a golf ball undergoes a small deformation as on short putts and approach shots, the hardness of the cover outer layer presenting the ball surface and the hardness of the cover inner layer have an influence on the control and feel of the ball.

Therefore, if the cover inner layer is soft and relatively thick as often found in prior art golf balls having a two-layer structure cover, the ball tends to receive too much spin on iron shots, inviting skying when hit into the wind. The spin increases probably because the stress reacting the impact force in a spin direction (tangential to the ball) increases due to the thickness of the inner layer. It was found that this tendency becomes outstanding on iron shots which apply a greater force in a tangential direction upon impact. These problems of skying and distance shortage must be solved before multi-piece solid golf balls can be more practically acceptable.

SUMMARY OF THE INVENTION

Therefore, an object of the invention is to provide a multi-piece solid golf ball which has sufficient spin properties to comply with different clubs and is improved in durability, feel, and distance.

The invention is directed to a multi-piece solid golf ball comprising a single solid core and a cover of two-layer structure consisting of an inner layer surrounding the single solid core and an outer layer surrounding the inner layer. In order to improve the spin, feel, durability and distance of the ball upon full shots with a driver and approach shots, we made investigations on the hardness and thickness of the cover layers and the hardness of the solid core. The inventors have found that by limiting the deflection of the solid core under a load of 100 kg to a specific range and optimizing the hardness and thickness of the cover inner and outer layers and the ratio in thickness of the outer layer to the inner layer, the ball is improved such that it may receive an appropriately increased spin rate upon approach shots. This leads to improved control, and a relatively low spin rate upon driver shots, which leads to an increased distance. Differently stated, the spin properties of the ball comply with different clubs. Additionally, the ball is fully durable against iron shots and presents a pleasant feel when hit.

To further improve the performance of this multi-piece solid golf ball, optimizing the outer diameter of the solid core is effective.

According to the invention, there is provided a multi-piece solid golf ball comprising a single solid core and a cover of two-layer structure consisting of an inner layer and an outer layer. The solid core has a deflection of 3 to 7 mm under an applied load of 100 kg. The cover inner layer has a Shore D hardness of 25 to 58 and a thickness of 0.5 to 1.4 mm. The cover outer layer has a Shore D hardness of 30 to 62 and a thickness of 1.2 to 2.3 mm. The ratio of the thickness of the cover outer layer to the thickness of the cover inner layer is from 1.1/1 to 4.6/1.

In one preferred embodiment, the solid core has a deflection of 3.0 to 6.5 mm under an applied load of 100 kg, the cover inner layer has a Shore D hardness of 25 to 55 and a thickness of 0.5 to 1.1 mm, the cover outer layer has a Shore D hardness of 30 to 60 and a thickness of 1.2 to 2.3 mm, the ratio of the thickness of the cover outer layer to the thickness of the cover inner layer is from 1.1/1 to 3.5/1, and the ball has a deflection of 3.0 to 6.7 mm under an applied load of 100 kg.

DETAILED DESCRIPTION OF THE INVENTION

Figure 1:
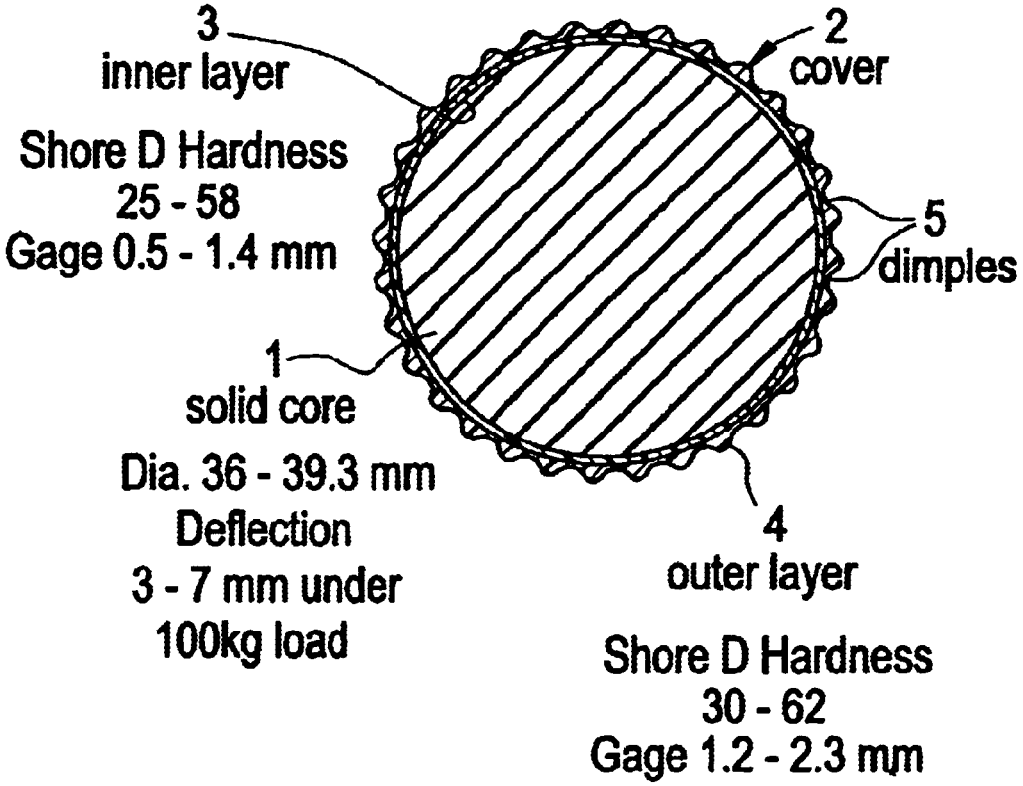
FIG. 1 is a cross-sectional view of the golf ball of this invention.

The multi-piece solid golf ball according to the present invention has a single spherical solid core 1 and a cover 2 formed on the surface of the core. The cover is formed to a two-layer structure consisting of a cover inner layer 3 surrounding the solid core and a cover outer layer 4 surrounding the inner layer. The ball is defined herein as a three-piece ball having a solid core of a single layer although the solid core can be a multilayer core consisting of two or more layers if necessary.

The solid core 1 is first described. The solid core may be formed from any of well-known materials, typically by molding under heat and pressure a well-known rubber composition comprising a base rubber blended with a co-crosslinking agent, a peroxide, an inert filler and optional additives. The structure of the solid core may be a single layer or a multilayer structure consisting of two or more layers. The base rubber used herein may be polybutadiene rubber or a mixture of polybutadiene and polyisoprene rubber commonly used in solid cores. For high resilience, the use of cis-1,4-polybutadiene containing at least 90% cis structure is especially preferable.

Co-crosslinking agents that can be used include zinc and magnesium salts of unsaturated fatty acids (e.g., acrylic acid and methacrylic acid) and esters such as trimethylpropane trimethacrylate. Zinc acrylate is especially preferable because of high resilience. The amount of co-crosslinking agent added is preferably about 15 to 30 parts by weight per 100 parts by weight of the base rubber. Exemplary peroxides are dicumyl peroxide and mixtures of dicumyl peroxide and 1,1-bis(t-butylperoxy)-3,3,5-trimethylcyclohexane. The peroxide is generally added in an amount of about 0.5 to 1.5 parts by weight per 100 parts by weight of the base rubber. Suitable inert fillers include zinc oxide, barium sulfate, silica, calcium carbonate and zinc carbonate, with zinc oxide and barium sulfate being most often used. The amount of the filler may be adjusted as appropriate. It is recommended to blend zinc oxide in an amount of at least 30% by weight of the entire filler for improving the resilience of the solid core.

From the rubber composition, the solid core can be formed by well-known methods. Typically the composition is worked in a conventional mixer such as a Banbury mixer or a roll mill, placed in a core mold, and then cured by heating at a sufficient temperature for the co-crosslinking agent and peroxide to function, obtaining a solid core.

A solid core 1 of multi-layer structure may be prepared by several methods, for example, a method involving preparing an appropriate rubber composition as described above, molding and heat vulcanizing the composition as described above into a center sphere serving as the innermost layer, and enclosing the center sphere with another rubber composition, followed by molding and heat vulcanization again. An alternative method involves injection molding a thermoplastic resin layer around the center sphere. In the latter case, the thermoplastic resin may be any of well-known ones, for example, ionomer resins, thermoplastic polyester elastomers, thermoplastic polyamide elastomers, and thermoplastic polyurethane elastomers.

According to the invention, the solid core 1 should yield a deflection of 3 to 7 mm, preferably 3.0 to 6.5 mm, and more preferably 3.0 to 6.0 mm, under an applied load of 100 kg. A core deflection of less than 3 mm leads to a hard feel whereas resilience becomes low with a core deflection of more than 7 mm.

It is recommended that the solid core 1 have an outer diameter of 36.0 to 39.3 mm, especially 36.3 to 39.0 mm. The resilience would become low with a diameter of less than 36.0 mm whereas a core with a diameter in excess of 39.3 mm would sometimes cause the deterioration of cut durability against the objects of the invention. Where the solid core has a multilayer structure of two or more layers, the outer diameter of the overall solid core should preferably fall in the above-described range.

The multi-piece solid golf ball of the invention is obtained by applying two cover layers on the above-described solid core to form a cover 2 of two-layer structure.

The cover stocks of which the cover inner and outer layers 3,4 are formed may be well-known cover stocks of the same or different types as long as they satisfy the requirements on the respective layers to be described later. Useful materials include ionomer resins such as Himilan 1705 and 1706 by Mitsui-duPont Polychemical K.K. and Surlyn AD8511 and 8512 by E.I. duPont; thermoplastic polyester elastomers such as Hytrel 3078 and 4047 by Toray-duPont K.K.; and hydrogenated butadiene-styrene block copolymers such as Dynalon E6100P by Nippon Synthetic Rubber K.K. These materials may be used alone or in admixture.

The cover inner layer 3 should have a Shore D hardness of 25 to 58, preferably 25 to 56, more preferably 28 to 56, most preferably 30 to 55. An inner layer with a Shore D hardness of less than 25 results in low resilience and increased spin whereas a Shore D hardness beyond 58 exacerbates the feel and spin. The upper limit of 55 in Shore D hardness is especially preferable. The cover outer layer 4 should have a Shore D hardness of 30 to 62, preferably 30 to 60, more preferably 35 to 60, most preferably 38 to 57. An outer layer with a Shore D hardness of less than 30 results in low resilience and increased spin whereas a Shore D hardness beyond 62 exacerbates the feel, spin and control.

The cover inner layer 3 should have a thickness of 0.5 to 1.4 mm, preferably 0.5 to 1.2 mm, more preferably 0.6 to 1.2 mm. The upper limit of 1.1 mm is especially preferable. The cover outer layer should have a thickness of 1.2 to 2.3 mm, preferably 1.4 to 2.1 mm. The ratio of the thickness of the cover outer layer to the thickness of the cover inner layer is from 1.1/1 to 4.6/1, preferably from 1.1/1 to 4.0/1, more preferably from 1.1/1 to 3.5/1. The thickness of the cover outer layer 4 is greater than the thickness of the cover inner layer. If this cover layer thickness ratio is less than 1.1, there arise several problem including a skying trajectory upon driver shots, failure to extend distance, and insufficient spin upon approach shots. If this ratio is more than 4.6, which means that the cover outer layer is too thicker than the cover inner layer, the effect of the cover inner layer is not fully exerted, failing to achieve the objects of the invention.

The cover inner and outer layers 3,4 can be formed by a well-known method. It is only necessary that the cover layers be formed on the preformed solid core so as to meet the above requirements. For example, cover stocks are successively injection molded over the solid core. Alternatively, a cover stock is preformed into a pair of hemispherical half cups for each of the inner and outer layers, the inner layer half cups and the outer layer half cups are mated and joined to give a pair of half cups of two-layer structure, the solid core is encased in the pair of half cups, and compression molding is effected at 110 to 160° C. for 2 to 10 minutes. In a further method, the solid core is encased in a pair of inner layer half cups, followed by compression molding at 110 to 160° C. for 2 to 10 minutes. The resulting part is placed in an injection mold, and the outer layer cover stock is injection molded.

The multi-piece solid golf ball is preferably adjusted to a hardness corresponding to a deflection of 3.0 to 6.7 mm, especially 3.2 to 6.5 mm, under an applied load of 100 kg because durability and hitting feel are further improved.

Like conventional golf balls, the multi-piece solid golf ball of the invention is formed with a multiplicity of dimples 5 in the cover surface. The ball may have about 350 to 500 dimples, preferably about 370 to 480 dimples. The dimples may include two or more types which are different in diameter and/or depth. Typically, the dimples have a diameter of 1.4 to 4.5 mm, especially 2.0 to 4.3 mm and a depth of 0.10 to 0.30 mm, especially 0.11 to 0.27 mm.

The multi-piece solid golf ball of the invention is prepared in accordance with the Rules of Golf, that is, to a diameter of not less than 42.67 mm and a weight of not greater than 45.93 grams.

There has been described a multi-piece solid golf ball which travels a satisfactory trajectory to extend distance upon driver shots and receives an appropriate spin rate to control upon approach shots. The ball is also improved in durability and feel.

EXAMPLE

Examples of the present invention are given below by way of illustration and not by way of limitation. All parts are by weight.

Examples 1–4 & Comparative Examples 1–3

Solid cores were prepared by kneading a rubber composition of the formulation shown in Table 1, and placing it in a mold, followed by heat pressure molding at 150° C. for 15 minutes. It is noted that a solid core designated No. 4 had an outer layer of ionomer resin which was formed by injection molding a core outer layer material around the solid core.

TABLE 1

| Solid core | ① | ② | ③ | ④ | ⑤ | ⑥ | ⑦ |
|---|---|---|---|---|---|---|---|
| Solid core (pbw) | | | | | | | |
| Cis-1,4-polybutadiene | 100 | 100 | 100 | 100 | 100 | 100 | 100 |
| Dicumyl peroxide | 1.2 | 1.2 | 1.2 | 1.2 | 1.2 | 1.2 | 1.2 |
| Barium sulfate | 3.9 | 20.1 | 12.8 | 36 | 13 | 10.7 | 42.5 |
| Zinc oxide | 5 | 5 | 5 | 5 | 5 | 5 | 5 |
| Antioxidant | 0.2 | 0.2 | 0.2 | 0.2 | 0.2 | 0.2 | 0.2 |
| Zinc salt of pentachlorothiophenol | 1 | 1 | 1 | 1 | 1 | 1 | 1 |
| Zinc acrylate | 31.8 | 25.9 | 22.2 | 25.9 | 34.8 | 37.0 | 29.6 |
| Core outer layer (pbw) | | | | | | | |
| Himilan AM7317 | — | — | — | 50 | — | — | — |
| Himilan AM7318 | — | — | — | 50 | — | — | — |

*Himilan is the trade name of ionomer resins by Mitsui-duPont Polychemical K. K.

Next, cover stocks of the formulation shown in Table 2 were milled in a twin-screw extruder, and molded into a pair of hemispherical half cups for each cover stock. These half cups were mated and joined in the combination shown in Table 3, giving a pair of half cups of two-layer structure.

The solid core was encased in the pair of half cups, followed by compression molding at 145° C. for 5 minutes. Multi-piece solid golf balls were prepared in this way.

The golf balls thus obtained were tested for flight performance (spin and distance), feel upon driver and putter shots, cut resistance and durability against repetitive hits. The results are shown in Table 4.

Flight Performance

Using a swing robot of True Temper Co., the golf balls were measured for spin, trajectory, carry, and total distance when hit with a driver (W#1) at a head speed of 50 m/s (HS50) and a No. 6 iron (I#6) at a head speed of 41 m/s (HS41).

Feel

The balls were driven by three professional golfers with a driver and a putter, who rated each ball according to the following criteria.

○: good

Δ: average

X: poor

Cut Resistance and Durability Against Repetitive Shots

Five balls were conditioned at 23° C. They were hit once with a pitching wedge (PW, loft angle 50°) at a head speed of 33 m/sec. in a half-top manner. The hit area of each ball was visually observed and evaluated according to the following criteria.

○: good

X: surface flaw or defects

The balls were continuously hit by means of a repetitive hitting machine and evaluated according to the following criteria.

○: sound

X: early broken

TABLE 2

| Cover | A | B | C | D | E | F | G |
|---|---|---|---|---|---|---|---|
| Formulation (pbw) | | | | | | | |
| Hytrel 3078 | 100 | — | — | — | — | — | — |
| Hytrel 4047 | — | 100 | — | — | — | — | — |
| Surlyn AD8511 | — | — | 30 | — | — | — | — |
| Surlyn AD8512 | — | — | 30 | — | — | — | — |
| Dynalon E6100P | — | — | 40 | — | — | — | — |
| Pandex T7298 | — | — | — | — | 100 | — | — |
| Pandex T7890 | — | — | — | — | — | 100 | — |
| Himilan 1706 | — | — | — | 40 | — | — | 50 |
| Himilan 1605 | — | — | — | — | — | — | 50 |
| Surlyn 8120 | — | — | — | 60 | — | — | — |
| Titanium dioxide | 0 | 0 | 5.13 | 5.13 | 2.7 | 2.7 | 5.13 |

Note that Hytrel is the trade mark for thermoplastic polyester elastomers by Toray-duPont K.K.;

Surlyn is the trade mark for ionomer resins by E. I. duPont;

Dynalon is the trade mark for hydrogenated butadiene-styrene block by Nippon Synthetic Rubber K.K.; and Pandex is the trade mark for thermoplastic polyurethane elastomers by Dai-Nippon Ink & Chemicals K.K.

TABLE 3

| | Example | | | | Comparative Example | | |
|---|---|---|---|---|---|---|---|
| | 1 | 2 | 3 | 4 | 1 | 2 | 3 |
| Solid core | | | | | | | |
| Type | ① | ② | ③ | ④ | ⑤ | ⑥ | ⑦ |
| Outer diameter (mm) | 38.1 | 36.9 | 37.5 | 38.3*1 | 36.0 | 38.7 | 32.7 |
| Specific gravity | 1.112 | 1.187 | 1.137 | 1.169 | 1.169 | 1.162 | 1.312 |
| Hardness*2 (mm) | 3.2 | 4.0 | 4.5 | 3.0 | 2.8 | 2.5 | 3.5 |
| Cover inner layer | | | | | | | |
| Type | A | B | C | A | B | D | D |
| Shore D hardness | 30 | 40 | 51 | 30 | 40 | 52 | 52 |
| Specific gravity | 1.08 | 1.12 | 0.951 | 1.08 | 1.12 | 0.977 | 0.977 |
| Thickness (mm) | 0.8 | 0.8 | 1.1 | 0.8 | 1.85 | 1.5 | 2.5 |
| Cover outer layer | | | | | | | |
| Type | E | D | F | C | D | G | G |

TABLE 3-continued

| | Example | | | | Comparative Example | | |
|---|---|---|---|---|---|---|---|
| | 1 | 2 | 3 | 4 | 1 | 2 | 3 |
| Shore D hardness | 50 | 52 | 39 | 51 | 52 | 65 | 65 |
| Specific gravity | 1.183 | 0.977 | 1.183 | 0.951 | 0.977 | 0.977 | 0.977 |
| Thickness (mm) | 1.5 | 2.1 | 1.5 | 1.4 | 1.5 | 0.5 | 2.5 |
| Outer/inner layer thickness ratio | 1.9 | 2.6 | 1.4 | 1.8 | 0.8 | 0.3 | 1.0 |
| Ball hardness*2 (mm) | 3.2 | 3.5 | 4.1 | 3.3 | 2.7 | 2.2 | 2.4 |

*1a total diameter of solid core and core outer layer
*2a deflection (mm) under a load of 100 kg

TABLE 4

| | Example | | | | Comparative Example | | |
|---|---|---|---|---|---|---|---|
| | 1 | 2 | 3 | 4 | 1 | 2 | 3 |
| W#1/HS50 | | | | | | | |
| Spin (rpm) | 2608 | 2444 | 2511 | 2647 | 2812 | 2723 | 2451 |
| Trajectory | gradually ramping good trajectory | | | | skying | relatively skying | good |
| Carry (m) | 242 | 241 | 241 | 242 | 239 | 239 | 240 |
| Total (m) | 261 | 262 | 263 | 260 | 256 | 258 | 261 |
| Feel | ○ | ○ | ○ | ○ | X | X | X |
| I#6/HS41 | | | | | | | |
| Spin (rpm) | 6100 | 6020 | 5980 | 6220 | 6400 | 5690 | 5310 |
| Trajectory | gradually ramping good trajectory | | | | skying | good | straight |
| Carry (m) | 148 | 147 | 148 | 148 | 145 | 147 | 147 |
| Total (m) | 153 | 153 | 154 | 152 | 148 | 154 | 155 |
| Putt Feel | ○ | ○ | ○ | ○ | ○ | Δ | X |
| Cut resistance | ○ | ○ | ○ | ○ | ○ | X | ○ |
| Durability | ○ | ○ | ○ | ○ | ○ | X | ○ |

Since the solid core yields an appropriate deformation, the cover inner and outer layers are optimized in hardness and thickness, and the cover outer layer thickness divided by the cover inner layer thickness is optimized, the multi-piece solid golf balls of the invention receive a less spin upon driver shots and thus travel a longer distance, but receive a more spin upon iron shots and are thus easy to control. Additionally, the balls of the invention are improved in hitting feel, cut resistance, and durability against repetitive shots.

In contrast, the golf balls of Comparative Examples 1 and 2 wherein the cover outer layer thickness divided by the cover inner layer thickness is too low, that is, the cover inner layer is thicker than the cover outer layer, follow a skying trajectory upon driver shots and are unsatisfactory in durability and hitting feel. The golf balls of Comparative Example 3 wherein the thickness of the cover outer layer is equal to the thickness of the cover inner layer receive a less spin upon iron shots and are thus difficult to control and present an unsatisfactory feel when hit.

Although some preferred embodiments have been described, many modifications and variations may be made thereto in the light of the above teachings. It is therefore to be understood that within the scope of the appended claims, the invention may be practiced otherwise than as specifically described.

What is claimed is:

1. A three piece solid golf ball comprising;

a single layer solid core, and a cover of two-layer structure consisting of an inner layer and an outer layer, wherein the inner layer is in direct contact with the solid core and said outer layer is placed directly over said inner layer, characterized in that:

the single solid core has a deflection of 3 to 7 mm under an applied load of 100 kg, the cover inner layer has a Shore D hardness of 25 to 58 and a thickness of 0.5 to 1.4 mm, the cover outer layer has a Shore D hardness of 30 to 57 and a thickness of 1.2 to 2.3 mm, and the ratio of the thickness of the cover outer layer to the thickness of the cover inner layer is from 1.4/1 to 4.6/1.

2. The multi-piece solid golf ball of claim 1, wherein the solid core has a deflection of 3.0 to 6.5 mm under an applied load of 100 kg, the cover inner layer has a Shore D hardness of 25 to 55 and a thickness of 0.5 to 1.1 mm, the cover outer layer has a Shore D hardness of 38 to 57 and a thickness of 1.2 to 2.3 mm, the ratio of the thickness of the cover outer layer to the thickness of the cover inner layer is from 1.1/1 to 3.5/1, and the ball has a deflection of 3.0 to 6.7 mm under an applied load of 100 kg.

3. The three piece golf ball of claim 1, wherein said single solid core has a diameter in the range of 36.0 to 39.3 mm.

4. The three piece golf ball of claim 1, wherein said cover inner layer has a Shore D hardness in the range of 30 to 55.

5. The three piece golf ball of claim 1, wherein said cover outer layer has a Shore D hardness in the range of 38 to 57.

6. The three piece golf ball of claim 1, wherein the ball has a deflection of 3.2 to 6.5 mm under a load of 100 kg.

7. A three piece solid golf ball comprising;

a solid core having uniform material composition throughout, and a cover of two-layer structure consisting of an inner layer and an outer layer, wherein the inner layer is in direct contact with said solid core and said outer layer is placed directly over said inner layer, characterized in that:

the single solid core has a deflection of 3 to 7 mm under an applied load of 100 kg, the cover inner layer has a Shore D hardness of 25 to 58 and a thickness of 0.5 to 1.4 mm, the cover outer layer has a Shore D hardness of 30 to 57 and a thickness of 1.2 to 2.3 mm, and the ratio of the thickness of the cover outer layer to the thickness of the cover inner layer is from 1.4/1 to 4.6/1.

8. The three piece golf ball of claim 7, wherein the solid core is a single layer solid core.

9. The three piece golf ball of claim 7, wherein the solid core has a deflection of 3.0 to 6.5 mm under an applied load of 100 kg, the cover inner layer has a Shore D hardness of 25 to 56 and a thickness of 0.5 to 1.4 mm, the cover outer layer has a Shore D hardness of 38 to 57 and a thickness of 1.2 to 2.3 mm, the ratio of the thickness of the cover outer layer to the thickness of the cover inner layer is from 1.1/1 to 3.5/1, and the ball has a deflection of 3.0 to 6.7 mm under an applied load of 100 kg.

10. The three piece golf ball of claim 7, wherein said solid core has a diameter in the range of 36.0 to 39.3 mm.

11. The three piece golf ball of claim 7, wherein said cover inner layer has a Shore D hardness in the range of 30 to 55.

12. The three piece golf ball of claim 7, wherein said cover outer layer has a Shore D hardness in the range of 38 to 57.

13. The three piece golf ball of claim 7, wherein the ball has a deflection of 3.2 to 6.5 mm under a load of 100 kg.

14. The three piece golf ball of claim 7, wherein the solid core has a deflection of 3.0 to 6.0 mm under an applied load of 100 kg.

15. The three piece golf ball of claim 7, wherein said solid core has a diameter in the range of 36.3 to 39.0 mm.

16. The three piece golf ball of claim 7, wherein said cover inner layer has a Shore D hardness in the range of 28 to 56.

17. A three piece solid golf ball comprising;

a solid single layer core having uniform material composition throughout, and a cover of two-layer structure consisting of an inner layer and an outer layer, wherein the inner layer is in direct contact with said solid core and said outer layer is placed directly over said inner layer, characterized in that:

the single solid core has a deflection of 3 to 6 mm under an applied load of 100 kg, the cover inner layer has a Shore D hardness of 30 to 55 and a thickness of 0.6 to 1.2 mm, the cover outer layer has a Shore D hardness of 38 to 57 and a thickness of 1.4 to 2.1 mm, and the ratio of the thickness of the cover outer layer to the thickness of the cover inner layer is from 1.1/1 to 3.5/1.

18. The three piece golf ball of claim 17, wherein said solid core has a diameter in the range of 36.3 to 39.0 mm.

19. The three piece golf ball of claim 17, wherein the ball has a deflection of 3.2 to 6.5 mm under a load of 100 kg.

20. The three piece golf ball of claim 17, wherein the ball has a deflection of 3.0 to 6.7 mm under a load of 100 kg.

* * * * *